United States Patent [19]

Mangin et al.

[11] Patent Number: 5,040,386

[45] Date of Patent: Aug. 20, 1991

[54] ANTIPANIC LOCK WITH A SAFETY-DRUM

[75] Inventors: Robert Mangin, St-Benoit-sur-Seine; Jean-Pierre Muller, Cormost; Francois Weil, Romilly-sur-Seine, all of France

[73] Assignee: Vachette, Paris, France

[21] Appl. No.: 552,748

[22] Filed: Jul. 16, 1990

[30] Foreign Application Priority Data

Aug. 2, 1989 [FR] France ..... 89 10416

[51] Int. Cl.[5] ..... E05B 65/10

[52] U.S. Cl. ..... 70/92; 70/139

[58] Field of Search ..... 70/92, 135, 139, 138; 292/21, 92

[56] References Cited

U.S. PATENT DOCUMENTS 2,962,889 12/1960 McConnell ..... 70/92

FOREIGN PATENT DOCUMENTS 757385 6/1933 France .

2254219 12/1973 France .

*Primary Examiner*—Robert L. Wolfe

*Attorney, Agent, or Firm*—Cushman, Darby & Cushman

[57] ABSTRACT

Safety-drum antipanic lock comprising a bolt (3, 103), an actuating rod pivotingly connected to the door, at each of its ends, by means of a unit formed by a housing (1, 101) fixed onto said door and a lever (2, 102) pivotingly mounted, in said housing (1, 101), at least one lever (2, 102) being an actuating lever cooperating with components of its housing (1, 101) to actuate the bolt (3, 103). The housing (1, 101) of the actuating lever (2, 102) is associated with at least a safety-drum (19, 20; 120) driving a bit (21, 23; 151) co-operating with actuating means for said housing to actuate the bolt (3, 103). Said housing (1, 101) of the actuating lever (2, 102) comprises at least two different operating means (14, 15*a*, 15*b*; 114) capable of separately co-operating each with a drum (19, 20; 120) to actuate said bolt (3, 103).

14 Claims, 2 Drawing Sheets

ANTIPANIC LOCK WITH A SAFETY-DRUM

FIELD OF THE INVENTION

This invention relates to an antipanic lock with a safety-drum and more particularly to an antipanic lock of the type of those fitted onto doors intended to be quickly opened from inside by simple actuation by an operator of a rod controlling the movement of the bolt of said lock in the keeper it is associated with. Such safety-locks are generally used on exit doors, and viz. emergency-exit doors of public premises (cinemas, theatres, etc . . . ) or the like, which should be capable of being quickly evacuated without being therefore of free access from outside. However, it appeared that it was necessary to provide such locks with actuating drums allowing, by means of keys, to operate, from outside, the doors fitted with these locks.

DESCRIPTION OF THE PRIOR ART

Classically, there exist two types of drums, the first ones being generally referred to as "cylindrical" drums and being such that their stator has substantially a straight section the periphery of which rests onto the whole or part of a circle centered about the axis of said drum, the other ones being generally referred to as "profiled" drums and being such that their stator is formed by a cylindrical main body topped, along one of its lengths, by a substantially parallelepipedic secondary body. Because of their difference in shape, until now, to each of these two types of drums corresponded a type of antipanic lock which was more particularly adapted to receive a drum of this type and enable same to cooperate with the components of the lock controlling the opening or closing motion of the lock. Hence, it was necessary, to be able to meet users' demands and their election of a drum, to simultaneously produce and keep in stock both antipanic locks adapted to cylindrical drums and antipanic locks adapted to profiled drums.

SUMMARY OF THE INVENTION

As far as this invention is concerned, it provides antipanic locks onto which it is possible to adapt both cylindrical drums and profiled drums, such locks comprising, in particular, recesses for both types of drums as well as components being capable of co-operating with the bits of both types of drum to actuate the bolt of the lock. In addition, the invention also provides antipanic locks with a drum and a side bolt the bolt-actuating housing of which is suited for both right-hand doors and left-hand doors.

Thus, the object of this invention is an antipanic lock with a safety-drum intended to be fitted onto a door and comprising at least a bolt allowing two positions, one enabling the opening of the door, the other one being a closing position in which said bolt can be engaged into a keeper, this lock comprising, furthermore, an actuating rod pivotably connected to said door, at each of its ends, by means of a unit formed by a housing fixed onto said door and a lever integral, towards its one end, with the actuating rod and pivotably mounted, at its other end, into said housing, at least one lever being an actuating pawl co-operating with components of its housing to actuate the bolt during the angular movement of said actuating rod, the actuating rod and the levers being intended to be pivoted in a first direction to control the opening of the door, the housing of the actuating lever being associated with at least a safety-drum comprising a stator inside which pivots a rotor driving a bit co-operating with actuating means to actuate the bolt, this lock being characterized in that said housing comprises at least two different operating means capable of cooperating, each separately, with a drum to actuate said bolt.

Advantageously, the housing of the actuating lever comprises actuating means intended to co-operate with the bit of a cylindrical drum and actuating means intended to co-operate with the bit of a profiled drum. The housing of the actuating lever may comprise at least two recesses for a drum, one being intended to be passed through by a part integral with the rotor of a cylindrical safety-drum, the other one being intended to be passed through by a part integral with the rotor of a profiled safety drum. The bolt may be a side bolt pivoting about an axis inside the housing of the actuating lever, between its opening position and its closing position in which it is projecting outside with respect to the housing, the above-mentioned actuating means comprising, on the bolt, at least a bearing area intended to co-operate with the bit of a cylindrical drum and at least a bearing area intended to co-operate with the bit of a profiled drum. Such a lock may also be used with an upper bolt and/or a lower bolt, of the type, e.g., of those described in the patent application in the name of the applicant, published under the number FR-A-2 609 492, without therefore departing from the framework of the invention.

Preferably, the bolt comprises a symmetry plane perpendicular to its pivoting axis. The bearing surface of the bit of the cylindrical drum may be a curved surface having as symmetry plane the symmetry plane of the bolt, said bolt comprising, furthermore, two bearing surfaces distributed on both sides of said curved surface and intended to co-operate with the bit of a profiled drum.

In an advantageous way, the actuating rod and the levers are reversible and can be pivoted in a second direction in order to control the opening of the door, the housing of the actuating lever comprising at least two recesses intended for receiving each a profiled drum, a drum in a first of these two recesses co-operating with the bolt-actuating means to actuate same when the actuating rod and the levers control the opening of the door by pivoting in the first direction, a drum in the second of these two recesses actuating the bolt when the actuating rod and the levers control the opening of the door by pivoting in a second direction.

In other embodiments, the actuating rod and the levers are reversible, the housing of the actuating lever comprising only a recess for a cylindrical drum and a recess for a profiled drum, the drum of the first recess actuating the bolt irrespective of the direction of controlling of the actuating rod and the levers.

Preferably, the axis of a drum is substantially perpendicular to the pivoting axis of the bolt. The control housing may comprise a bottom intended to be fixed onto a door, a drum passing through said bottom so that its bit is located inside said housing. Two recesses for a profiled drum may be symmetrically distributed with respect to the symmetry plane of the bolt. The cylindrical drum may be a drum with an off-centre rotor. The key slot of the rotor may be horizontal when the lock is in place on a door and the rotor is in a neutral position.

In an advantageous embodiment, the housing of the actuating lever comprises, in its bottom, at least a recess intended for receiving a cylindrical drum and at least a recess intended for receiving a profiled drum.

In another advantageous embodiment, the bit associated with the cylindrical drum is driven in motion by an intermediate member connected to the rotor. The intermediate member may be a gear-wheel passing through the housing into a recess at the level of one of the walls of same, the toothing of said wheel cooperating with a toothing which the bit is provided with, said bit being pivotingly mounted onto the bottom of said housing.

We will now describe, in a merely illustrative and not limiting way, an embodiment of an antipanic lock with a drum, according to the invention, whereby this description should be read with reference to the attached drawings.

DETAILED DESCRIPTION OF THE INVENTION

In FIGS. 1 through 4, it is seen that an antipanic lock according to a first embodiment comprises, in a classical way, an actuating rod (not shown) integral, at each of its ends, with levers, pivotingly mounted about a same axis, into housings intended to be fixed by their bottom onto a plate P of the door onto which is to be fitted said antipanic lock. One of these levers is an actuating lever 2 co-operating with elements of the housing 1 which it is associated with to actuate the bolt 3 of said lock between its opening position and its closing position.

Figure 1:
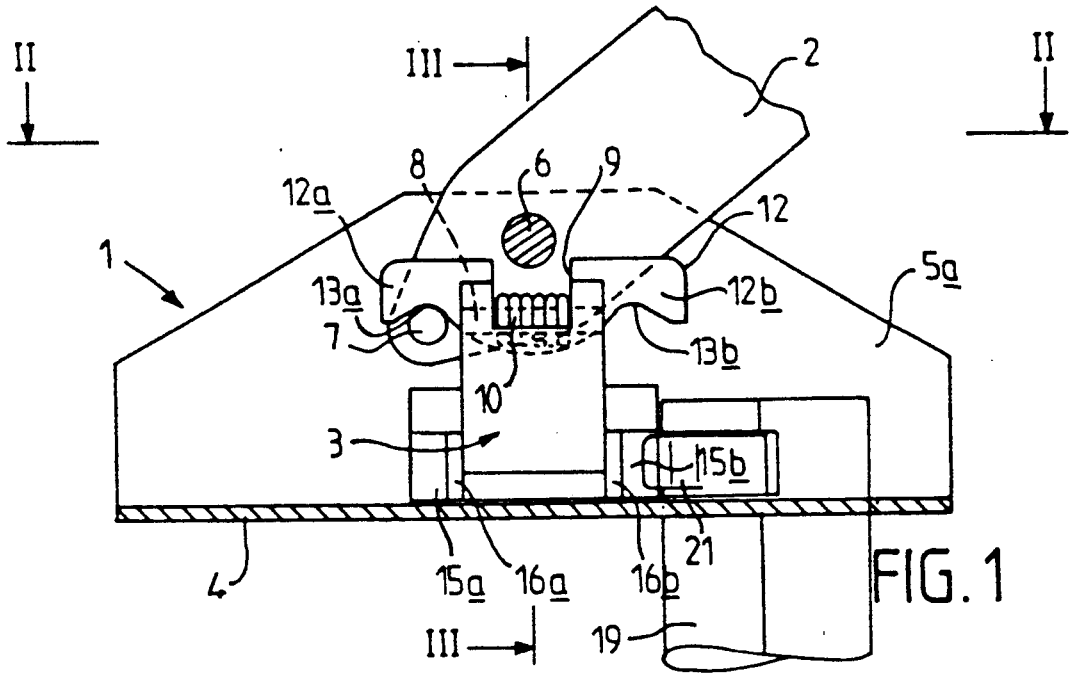
FIG. 1 is a cross-sectional view of a detail of an antipanic lock with a drum according to a first embodiment of the invention, said lock being provided with a profiled drum.
Figure 2:
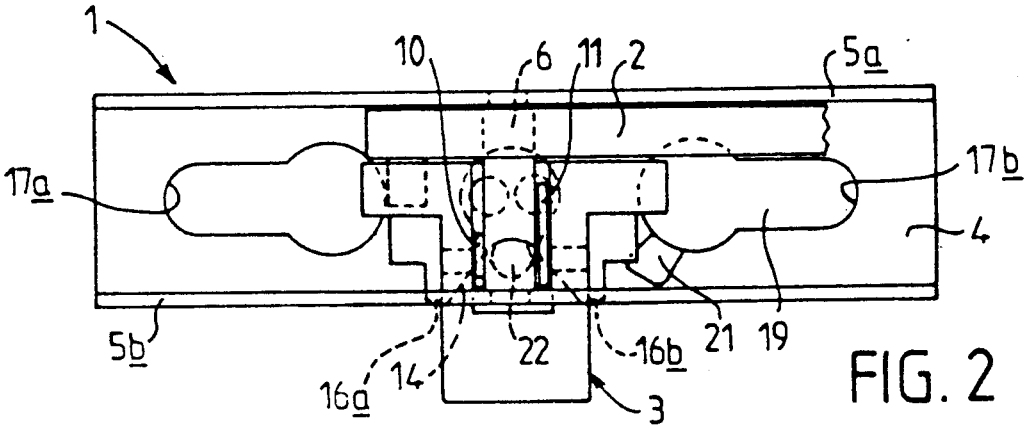
FIG. 2 is a view according to line II—II of FIG. 1 of the same detail, said lock being associated, at the same time, with a profiled drum and a cylindrical drum.
Figure 3:
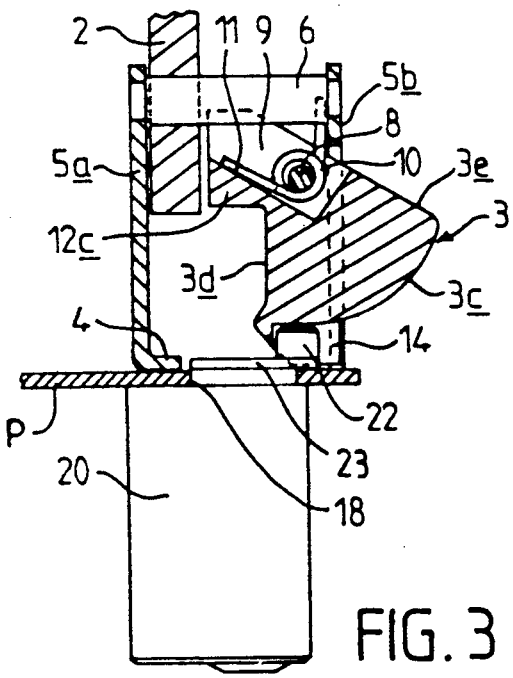
FIG. 3 is a view according to line III—III of FIG. 1.
Figure 4:
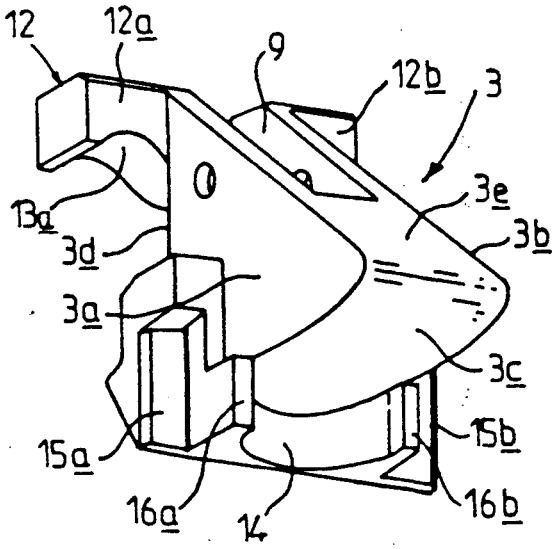
FIG. 4 is a perspective view of the bolt of the antipanic lock of the FIGS. 1 through 3.

In FIGS. 1 through 3 is shown the housing 1 associated with the actuating lever 2 controlling the movement of a side bolt 3 pivotingly mounted into said housing.

Said housing 1 comprises a rectangular bottom 4 edged with two walls 5*a* and 5*b* opposite to each other and perpendicular to said bottom 4. These walls 5*a* and 5*b* are identical and have the shape of a rectangular the length of which is the length of the bottom, this rectangular being topped by an isosceles trapezium the main base of which is that of the side lengths of said rectangular farthest away from said bottom 4. The plane perpendicular to the bottom 4, passing through the median width of the housing 1, is a symmetry plane for the bottom 4 and for said walls 5*a*, 5*b*. Lever 2 is a substantially elongated rectangular blade comprising, at its one end, a sleeve into which fits the actuating rod (not shown) of said antipanic lock. This lever 2 is hinged, towards its other end, about a pivoting spindle 6 which is a rod passing through the housing 1 while extending perpendicularly between both said walls 5*a*, 5*b*, substantially between their trapezoidal parts, at the level of said symmetry plane of said walls. Lever 2 is parallel to the walls 5*a*, 5*b* and adjacent to wall 5*a*, which is the one of both walls closest to the other housing of the lock. Its end opposite to the actuating rod has the shape, beyond the pivoting rod 6, substantially of a triangle the apex of which is rounded. At the level of this end is arranged, projecting with respect to said lever 2, on the side of said lever 2 farthest away from the wall 5*a*, a cylindrical pawl 7, having an axis, perpendicular to the plane of said lever 2, built-in in said lever 2, the length of which, outside said lever 2, substantially corresponds to the thickness of said lever 2.

The bolt 3 is pivotingly mounted, centred with respect to the symmetry plane of the walls of the housing, onto a spindle 8 adjacent to the wall 5*b*, parallel to the length of the housing 1 and arranged, with respect to the axis of the pivoting spindle 6 of the lever 2, at a distance smaller than the distance between the axes of spindle 6 and pawl 7. The bolt 3 has substantially a main shape defined by two sidewalls 3*a* and 3*b* parallel to the symmetry plane of the walls of the housing 1 and connected to each other by a main body the surface of which is parallel to the axis of spindle 8, the straight section of this main body being substantially a triangle one side of which is an arc of a circle centred or not 20 with respect to the axis of spindle 8. A wall 3*c*, formed by a portion of a cylindrical surface centred with respect to the spindle 8, corresponds to this side in the shape of an arc of a circle. Said spindle 8 passes through said main shape towards its edge opposite to wall 3*c*. The bolt 3 passes so through wall 5*b* that its one edge limiting its cylindrical wall 3*c* be located outside the housing 1, the other one being located inside said housing 1. The wall of the bolt located inside the housing 1 is designated by reference numeral 3*d*, the wall located, at least partly, inside the housing 1 being de-signated by reference numeral 3*e*.

This bolt 3 comprises, furthermore, a straight parallelepipedic recess 9 passed through by the rod 8 and opening onto the wall 3*e* in the vicinity of its edge opposite to the curved wall 3*c*, the bottom of this recess being parallel or not to the wall 3*e*. In this recess 9, passed through by the rod 8, is swivelled onto the rod 8, a spring 10 ending in two legs 11, one leg 11 coming to rest against the recess 9, the other leg 11 resting against the wall 5*b*.

The bolt 3 is, furthermore, extended substantially at the level of its pivoting axis, beyond its wall 3*d* and towards the outer side of the bolt 3, by a journal 12 comprising two legs 12*a* and 12*b* extending on both sides of the walls 3*a* and 3*b* of said bolt 3, respectively, and connected between them by a part 12*c* having a curved shape, each of these two legs being associated, at its part in front of the bottom 4, with a notch, designated by the reference numerals 13*a* and 13*b*, respectively, intended for co-operating with the pawl 7 according to the angular position of lever 2 with respect to the housing, the curved form of the area 12*c* authorizing the pivoting of the pawl 7 between these two notches 13*a* and 13*b*. In addition, the wall 3*d* of said bolt 3 is extended beyond the wall 3*c* by a bearing wall 14 curved according to an arc of a curve the concavity of which is oriented towards the wall 5*b* and the axis of which is perpendicular to the plane of the bottom 4 and in the symmetry plane of the bolt 3. The edge of this wall 14 located radially outside with respect to the rod 8 is arranged so as to enable the rotation of the bolt 3, about rod 8, towards the inner side of the housing 1.

Each of the walls 3*a* and 3*b* is associated with an earshaped recess, designated by the reference numerals 15*a* and 15*b*, respectively, which is a recess made in a parallelepipedic body made integral by one of its faces with one of the faces 3*a* and 3*b* , this recess being open towards the outer side of the bolt 3 and being defined by three rectangular and perpendicular walls, one of which is parallel to the wall 3*d*, another one is parallel to the walls 3*a* and 3*b*, the last one being the one among the walls of said recess which is closest to the axis of the rod 8. The recesses 15*a* or 15*b* thus defined are located substantially at the level of the bearing surface 14 and are separated from said bearing surface 14 by an extension 16*a* or 16*b* of its wall which is parallel to the walls 3*a* and 3*b*.

On the bottom 4 are cut out three recesses 17*a*, 17*b*, 18 for a drum, two of these recesses 17*a*, 17*b* being recesses for a profiled drum, distributed on each side of the bolt 3, symmetrically with respect to the symmetry plane of same, the third one of these recesses being a recess 18 for a cylindrical drum. Theses recesses 17*a*, 17*b* and 18 have a straight section corresponding to the straight section of the drum they are associated with, the part of the recesses 17*a* and 17*b* intended for receiving the parallelepipedic secondary body of a profiled drum being farther away from the bolt 3 than their part intended for receiving the main body of said drum.

In FIGS. 1 and 2 is shown a profiled drum 19 in place in the recess 17*a*, the bit 21 of said drum 19 projecting inside the housing 1 with respect to the cylindrical wall of this drum 19 and being intended to co-operate with the ear-shaped recess 15*b* and to come and rest against the wall of said recess 15*b*, which is perpendicular to the extension 16*b*, in order to cause the bolt 3 to pivot. It is also possible to arrange a profiled drum in the recess 17*a*, its bit then co-operating with the ear-shaped recess 15*a*.

In the cylindrical recess 18 is mounted a cylindrical drum 20 with an off-center or centred rotor the bit 23 of which is formed by a flat component connected to the rotor, which pivots about the axis of the rotor and on which is arranged an off-center pawl 22 resting against the surface 14 and intended to co-oeperate with said surface to cause the bolt 3 to pivot. The key-slot of the rotor is intended to be horizontal, in the neutral position of the rotor, when the unit is fitted onto a door, i.e. perpendicular to the walls 5*a* and 5*b* of the housing 1, the rotor part of said drum 20 being substantially on the axis of the housing 1.

In other embodiments, which are not shown, the housing could comprise only one recess for a profiled drum arranged on either side of the bolt, the bolt 3 described above being suitable for each of both sides. In still other embodiments, the housing could comprise only two recesses for a profiled drum and comprise no recess for a cylindrical drum.

To use a housing-lever unit, as shown in the Figures, one elects, in a first step, the direction in which one wants to actuate the lever 2 of said housing 1, i.e. that one of both dihedrons defined by the bottom 4 of the housing 1 and the plane perpendicular to said bottom 4 passing through the axis 6, in which one wants said lever 2 and the actuating rod to be located with respect to the plane of the bottom of the housing 1.

This being done, it is possible to actuate the bolt 3 by acting onto the actuating rod in order to cause the lever 2 to pivot about its axis 6, according to an angular movement during which the pawl 7 co-operates with one of the notches 13*a* or 13*b* of the journal 12 to lift same with respect to the bottom 4 and cause the bolt 3 to pivot about itself, in order to move same into its opening position, such a mechanism allowing to open a door from inside. When the operator releases its action onto the actuating rod, the bolt 3 automatically returns into its closing position, under the action of the legs 11 of the spring 10 swivelled inside the recess 9.

Furthermore, when such a housing is fitted onto a door, it is possible to associate same with a cylindrical drum 20 or a profiled drum 19. If one elects to associate same with a profiled drum, this latter will, preferably, be arranged in that of both recesses 17*a* or 17*b* which is on the side opposite to the triangular end of the lever 2, with respect to the symmetry plane of the bolt 3. Once the unit is in place, it is possible to act onto the bolt 3, from outside, by inserting the key, associated with the drum one has elected, into the rotor of this latter and by causing same to rotate in its stator, which results, for a cylindrical drum, into pushing-back the bearing surface 14 by means of the bit 23 and the pawl 22 and, for a profiled drum, into pushing-back one of the bearing ears 15*a* or 15*b* by means of the bit 21 of this drum. Thus, the tilting of the bolt 3 inside the housing I is caused, which disengages said bolt 3 from the keeper it was associated with and releases the pivoting of the door about itself.

The housing 1, provided with the recesses 17*a*, 17*b*, is reversible and may be fitted indifferently onto a "right-hand" or "left-hand" type door, thanks to a suitable orientation of the housing 1 for the fitting and to the arrangement of a profiled drum in that of the recesses 17*a*, 17*b*, which is suitable for the envisaged case.

Figure 5:
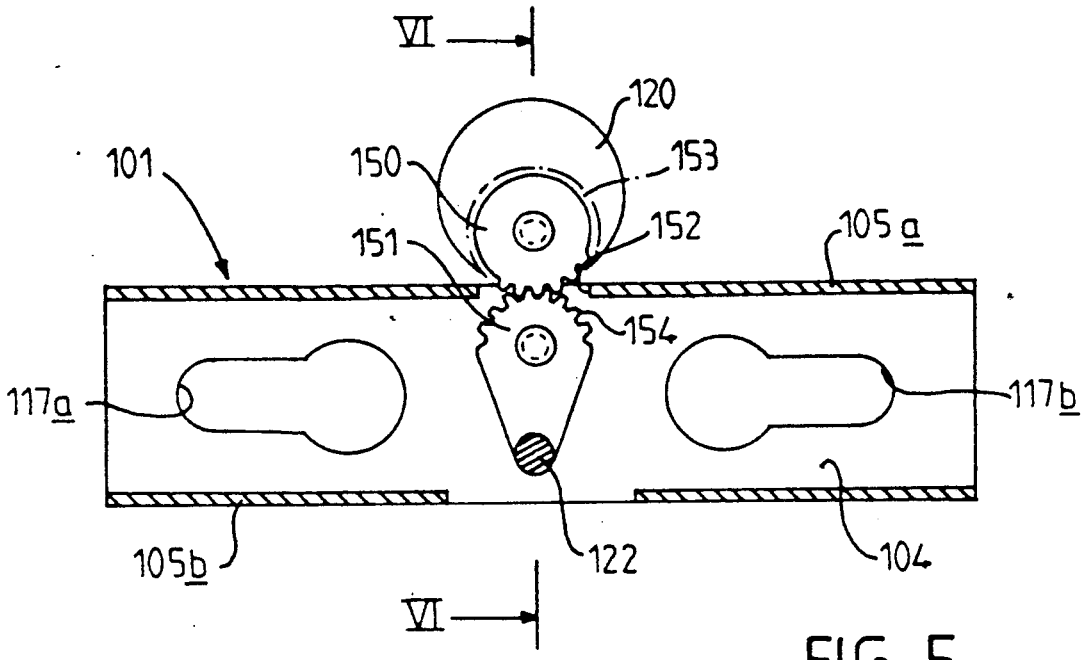
FIG. 5 is a cross-sectional view according to line V—V of FIG. 6 of a detail of an antipanic lock according to a second embodiment of the invention.
Figure 6:
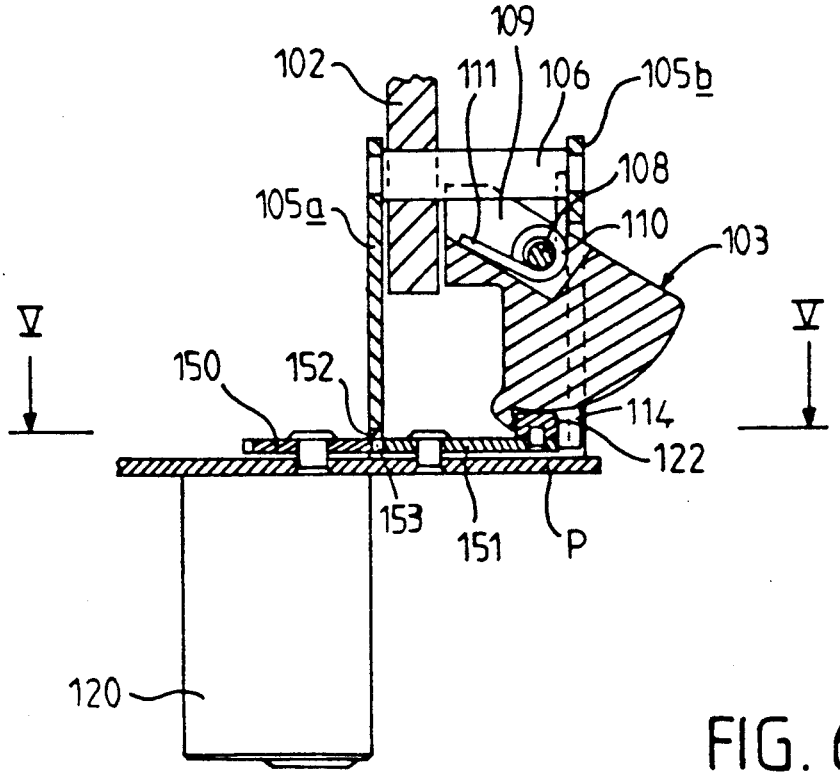
FIG. 6, finally, is a cross-sectional view with an extraction according to line VI—VI of FIG. 5

In FIGS. 5 and 6 is shown a second embodiment of the invention for which have been taken over, for the components of this second embodiment which are to be found in the first embodiment, the same reference numerals increased by one hundred.

This antipanic lock comprises, in the same way, an actuating rod mounted onto articulated levers in housings fixed onto a plate, designated by P, of the door. One of these levers, designated by reference numeral 102 and mounted in a housing 101, is an actuating lever pivotably actuating the bolt 103 of the lock. On the bottom 104 of the housing 101 are provided for two recesses 117*a* and 117*b* for a profiled cylinder.

This housing 101 is also associated with a cylindrical drum 120 the rotor of which is not mounted onto the bottom 104 of said housing 101, but passes through the plate P next to same, the stator of said drum extending on the side of said plate P opposite to said housing 101. On the other side of said plate P is mounted, on the end of the rotor, a gear-wheel 150 which is a flat disc the edge of which comprises a transmission toothing 153, this wheel 150 being centred with respect to the axis of said rotor and passing through, substantially at the level of its toothing, through a recess 152, that of the walls of the control housing 101 which is closest to the other housing of the lock. On the bottom 104 of the control housing 101 is pivotably mounted a flat component 151, which is a bit part of which is a portion of the gear-wheel the toothing 154 of which is intended to pivotably co-operate with the toothing 153 of the wheel 150, this part being extended by an elongated part provided with a pawl 122 extending perpendicularly to the bottom 104 of the housing 101. This pawl 122 is intended to cooperate with the bearing wall of the bolt 103 associated with said control housing 101 to cause said bolt 103 to pivot, this bolt 103 being substantially identical to the bolt 3 which has been described above. Thus, with a device according to this variant, it is possible to separate the cylindrical drum from the edge of the door, which is not the case with a device according to the first embodiment described, the bottom of the control housing being generally arranged immediately next to said edge. Here, the pivoting of the bit 151 is obtained thanks to an intermediate member between said bit 151 and said rotor, the symmetry of the bolt-actuating means with respect to the median plane of said bolt being maintained.

We claim:

1. An anti-panic lock of the kind including a safety drum and for fitting on a door with an operating lever on one side of the door and the safety drum accessible on the other side of the door, said lock comprising housing means supporting a bolt for pivoting movement between a locked and an unlocked position for engagement and corresponding disengagement with a keeper, said operating lever adjacent one end being pivotally mounted on said housing means and engaging said bolt so that movement of said lever in one direction will effect movement of said bolt from said locked to said unlocked position, said housing means including a safety drum having a stator and a rotor inside said stator, a drive member carried by said rotor for engaging said bolt to move said bolt from said locked to said unlocked position upon rotation of said rotor, said housing means including first and second mounting means each for mounting a said safety drum in a selected orientation relative to said bolt and at least two operating means, one associated with said first mounting means and the other associated with said second mounting means and each for cooperating with a said safety drum when a said safety drum is mounted in a respective mounting means.

2. The lock as claimed in claim 1, wherein said first mounting means is adapted to cooperate with a cylindrical safety-drum while said second mounting means is adapted to cooperate with a non-cylindrical safety-drum.

3. The lock as claimed in claim 2, wherein said first mounting means comprises a recess formed in said housing for receiving a portion of said cylindrical safety-drum, said second mounting means comprising a recess shaped for receiving therethrough a portion integral with the rotor of a non-cylindrical safety-drum.

4. The lock as claimed in claim 2, wherein said housing means includes a side wall having an opening and said bolt is pivotably mounted to move through said opening into said housing when said bolt is moved from said locked to said unlocked position, one of said operating means including a bearing surface engageable by a said drive member of a said safety-drum with said other operating means comprising a bearing area for cooperating with a drive member of a said safety-drum when mounted on said second mounting means of said housing.

5. The lock as claimed in claim 4, wherein said bolt includes a pivot axis and is formed symmetrically relative to a plane extending perpendicular to said pivot axis.

6. The lock as claimed in claim 5, wherein said bearing surface is a curved wall having a plane of symmetry coextensive with the plane of symmetry of said bolt, said bolt including two bearing surfaces one disposed on one side of said curved wall and the other disposed on the other side of said curved wall so as to be engageable with a said drive member of a said safety drum.

7. The lock as claimed in claim 6, wherein said bolt is pivotably mounted on said housing between two recesses formed in said housing on opposite sides of the location of said bolt, one of said recesses being adapted to receive a non-cylindrical safety-drum at the option of the user whereby the direction of pivoting of said operating lever is selectable by a user.

8. The lock as claimed in claim 5, wherein the said safety-drum has an axis which extends substantially perpendicular to the pivot axis of said bolt.

9. The lock as claimed in claim 1, wherein said housing means includes a bottom wall adapted to be fixed to a door with said safety-drum extending through said bottom wall and with said drive member thereof disposed within said housing means.

10. The lock as claimed in claim 7, wherein said two recesses are disposed in said housing means symmetrically with respect to the plane of symmetry of said bolt.

11. The lock as claimed in claim 4, wherein said safety-drum includes a key slot in the rotor thereof and said housing means includes a wall surface for attachment to a door whereby the key slot will extend substantially horizontally when said lock is in place on the door and the rotor is in a neutral position.

12. The lock as claimed in claim 3, wherein said housing means includes a bottom wall having said recesses for said cylindrical safety-drum and said non-cylindrical safety-drum.

13. The lock as claimed in claim 3, wherein a cylindrical safety-drum is provided with a rotor and is mounted adjacent said housing means, said rotor being connected to an intermediate member, said intermediate member being connected to said drive member.

14. The lock as claimed in claim 13, wherein said intermediate member includes a gear wheel and said housing means includes an opening through which said gear wheel extends, said drive member including a set of teeth positioned to cooperate with said gear wheel, said drive member being pivotably mounted on a bottom wall of said housing means.

* * * * *